US006786578B1

(12) United States Patent
Aschman et al.

(10) Patent No.: US 6,786,578 B1
(45) Date of Patent: Sep. 7, 2004

(54) MULTI-COLOR, MULTI-SPEED PRINTING APPARATUS

(75) Inventors: Richard P. Aschman, Laconia, NH (US); John P. Duffield, Meredith, NH (US); Peter Heath, Laconia, NH (US)

(73) Assignee: Vutek, Inc., Meredith, NH (US)

( * ) Notice: Subject to any disclaimer, the term of this patent is extended or adjusted under 35 U.S.C. 154(b) by 47 days.

(21) Appl. No.: 10/100,281

(22) Filed: Mar. 15, 2002

Related U.S. Application Data

(60) Provisional application No. 60/276,317, filed on Mar. 16, 2001.

(51) Int. Cl.[7] ..... B41J 2/175
(52) U.S. Cl. ..... 347/85
(58) Field of Search ..... 347/7, 43, 30, 347/85, 86, 87, 84

(56) References Cited

U.S. PATENT DOCUMENTS 4,422,085 A * 12/1983 Sumitomo et al. ..... 347/7
4,526,102 A * 7/1985 Grobman ..... 101/425
5,751,321 A 5/1998 Erickson
5,833,743 A 11/1998 Elwakil
5,877,793 A 3/1999 Erickson
6,027,199 A 2/2000 Reed
6,079,808 A * 6/2000 Yamaguchi ..... 347/30
6,164,766 A 12/2000 Erickson
6,206,511 B1 * 3/2001 Cook et al. ..... 347/85

* cited by examiner

*Primary Examiner*—Anh T. N. Vo
(74) *Attorney, Agent, or Firm*—Hamilton, Brook, Smith & Reynolds, P.C.

(57) ABSTRACT

A printing apparatus for printing images on a substrate. The printing apparatus is provided with a first print head connected to a selector valve which in turn is connected to a pair of reservoirs. The first reservoir holds one type of ink while the other reservoir holds a different type of ink. The selector valve has two selectable states. The first state facilitates transmitting ink from one of the reservoirs to the print head, and the second state facilitates transmitting ink from the other reservoir to the print head. The selector valve can be coupled to a controller which is computer operated. Alternatively, the controller can be manually operated.

24 Claims, 5 Drawing Sheets

MULTI-COLOR, MULTI-SPEED PRINTING APPARATUS

RELATED APPLICATIONS

This application claims the benefit of U.S. Provisional Application No. 60/276,317, filed Mar. 16, 2001, the entire teachings of which are incorporated herein by reference.

BACKGROUND OF THE INVENTION

Certain types of printing systems are adapted for printing images on large-scale substrates, such as for museum displays, billboards, sails, bus boards, and banners. Some of these systems use so-called drop on demand ink jet printing. In these systems, a carriage which holds a set of print heads scans across the width of the substrate while the print heads deposit ink as the substrate moves.

Some of these systems use different colored inks to create the desired images. For instance, black, yellow, cyan, and magenta colored inks are commonly employed alone or in combination to generate the image. Other systems use additional colored inks, such as light black, light yellow, light cyan, and light magenta to create images with higher resolution. In general, images created with a greater number of colored inks are typically of higher quality than those generated with fewer colored inks.

Certain applications require a printing system that has different modes of operation, for example, one mode enables printing images at high speeds, and another mode enables the system to print higher quality images at a lower speed. In these systems, certain print heads, as well as the ink transmission lines connected to the print heads, must be removed and exchanged when switching the printing system from one mode of operation to the other mode.

SUMMARY

Such printing systems have been accepted in the industry, and they are presumably considered to perform reasonably well for their intended purpose. However, it is desirable, in some circumstances, to be able to switch the type (e.g. color or fast drying versus slow drying ink) of the ink which is transmitted to a particular print head without having to remove the print head and the corresponding transmission line which transmits the ink from an ink reservoir to the print head.

The present invention greatly reduces problems encountered by the aforementioned prior art printing systems. The present invention provides an efficient printing system which is capable of printing high quality images with several colored inks and printing images at greater speeds with fewer colored inks.

In one aspect, the present invention implements a printing apparatus for printing images on a substrate that has two modes of operation. The printing apparatus is provided with a first print head connected to a selector valve which in turn is connected to at least a pair of reservoirs. The first reservoir holds one colored ink while the another reservoir holds a different colored ink. The selector valve has at least two selectable states. The first state facilitates transmitting ink from one of the reservoirs to the print head, and the second state facilitates transmitting ink from the other reservoir to the print head. The selector valve can be coupled to a controller which is computer operated. Alternatively, the controller can be manually operated.

Embodiments of this aspect of the invention can have one or more of the following features. The printing system includes a second print head which receives ink directly from the second reservoir. Alternatively, the second print head can be connected to the selector valve such that the second print head receives ink from the first reservoir when the selector valve is in the first state and receives ink from the second reservoir when the selector valve is in the second state. In this arrangement, there can be a second pair of print heads which receive ink directly from the second reservoir.

Optionally, there can be one or more additional sets of print heads, and an equal number of additional selector valves and additional pairs of reservoirs. Each set includes two pair of print heads: one pair of print heads receives ink directly from one of the reservoirs of the respective pair of reservoirs, and the other pair of print heads is connected to a respective selector valve which in turn is connected to the other reservoir of the respective pair of reservoirs. Here again, each selector valve has two states which enables transmitting ink from either reservoir to the pair of print heads connected to the selector valve.

In one embodiment, there is a total of sixteen print heads, four selector valves, and four pairs of ink reservoirs. The first reservoir and the second reservoir of the first pair of reservoirs holds light black ink, and dark black ink, respectively; the first reservoir and the second reservoir of the second pair of reservoirs holds light yellow ink, and dark yellow ink, respectively; the first reservoir and the second reservoir of the third pair of reservoirs holds light cyan ink, and dark cyan ink, respectively; and the first reservoir and the second reservoir of the fourth pair of reservoirs holds light magenta ink, and dark magenta ink, respectively.

In some embodiments, the second set of print heads is positioned between the first pair and the second pair of the first set of print heads, the third set of print heads is positioned between the first pair and the second pair of the second set of print heads, and the fourth set of print heads is positioned between the first pair and the second pair of the third set.

In ceratin embodiments, the first pair and the second pair of the second set are positioned adjacent to the first pair and the second pair of the first set, respectively; the first pair and the second pair of the third set are positioned adjacent the first pair and the second pair of the second set, respectively; and the first pair and the second pair of the fourth set are positioned adjacent to the first pair and the second pair of the third set, respectively, so that the first pair and the second pair of fourth set are also positioned adjacent to each other.

In certain embodiments, the printing system includes a flushing mechanism to cleanse the selector valve and the transmission lines when the selector valve is switched from the first state to the second state or vice versa. The system can be flushed before the selector valve is changed, or, alternatively, after it is switched to a different state.

Related aspects include a method of printing images on a substrate. The method includes depositing a first ink or a second ink from a first print head, and selecting between a first state of operation and a second state of operation. When in the first state of operation a first reservoir holding the first ink is in fluid communication with the first print head, and when in the second state of operation a second reservoir holding the second ink is in fluid communication with the first print head.

Some embodiments may have one or more of the following advantages. The printing system can be switched from a high-quality operation to a high-speed operation in a relatively short period of time, for example, in just a few minutes. The entire switching operation can be automated without manual intervention. Thus, nothing has to be manually removed from the printing system to switch the operating mode of the system.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
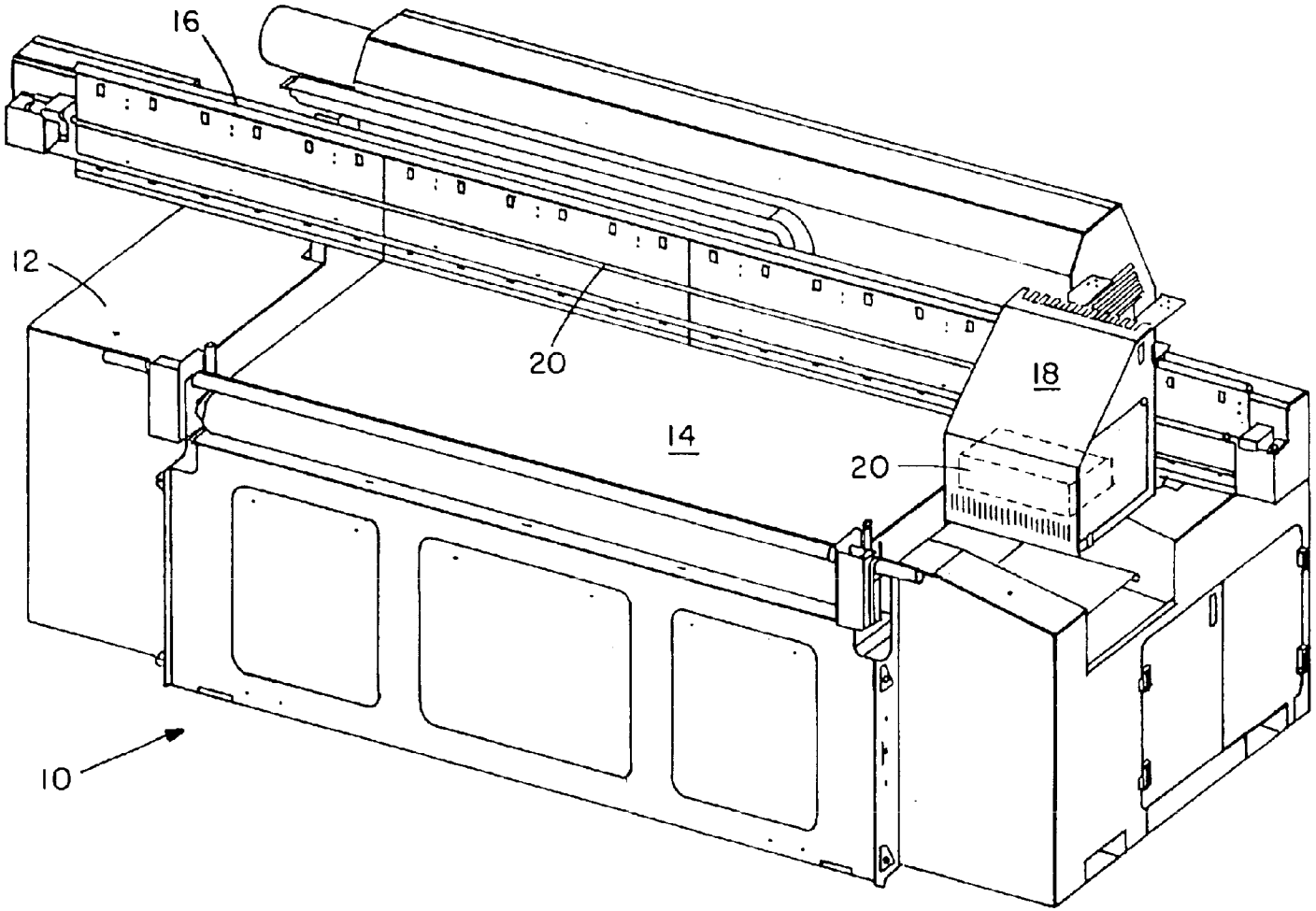
FIG. 1 is a perspective view of a printing system.

Turning now to the drawings, there is shown in FIG. 1 a printing system, generally identified as 10, provided with a carriage 18. The carriage 18 holds a series of ink jet print heads 20 configured for printing images on a variety of substrates. Typical substrates are polyvinyl chloride (PVC) and reinforced vinyl. The printing system 10 is able to print on flexible as well as on non-flexible substrates, such as, for example, metals, glass, and plastics.

The printing system 10 prints multi-colored images using the colored inks black(K), light black (LK), yellow (Y), light yellow (LY), cyan (C), light cyan (LC), magenta (M), and light magenta (LM). Various colors of a particular image are created by combining these colored inks. Furthermore, the printing system 10 has two modes of operation. In a first mode or state, the printing system 10 creates images with all eight colors, K, LK, Y, LY, C, LC, M, and LM, while in a second mode or state, the printing system 10 uses only the four base colors K, Y, C, and M. Typically, images of higher quality are produced in the first mode, and the second mode of operation is used when higher print speeds are desired. The printing system 10 is able to switch between the two modes of operation without an operator having to replace the print heads nor having to disconnect the print heads from one set of ink reservoirs and reconnecting the print heads to another set of ink reservoirs.

In addition to the carriage 18, the printing system 10 includes a base 12, a transport belt 14 which moves a substrate positioned on top of the belt 14 through the printing system 10, and a rail system 16 attached to the base 12. The carriage 18 is attached to a belt 22 which is wrapped around a pair of pulleys positioned on either end of the rail system 16. A carriage motor is coupled to one of the pulleys and rotates the pulley during the printing process. Accordingly, as the transport bel 14 intermittently moves the substrate 23 (FIG. 2) underneath the carriage 18, and hence the series of print heads 20, the pulleys translate the rotary motion of the motor to a liner motion of the belt 22 thereby causing the carriage 18 to traverse back and forth along the rail system 16 across the substrate 23 as the series of print heads 20 deposit ink onto the substrate 23. More particularly, as illustrated in FIG. 2, the carriage 18 moves back and forth as indicated by the arrow A as the substrate 23 moves intermittently in the direction of arrow B underneath the print heads 20.

Figure 2:
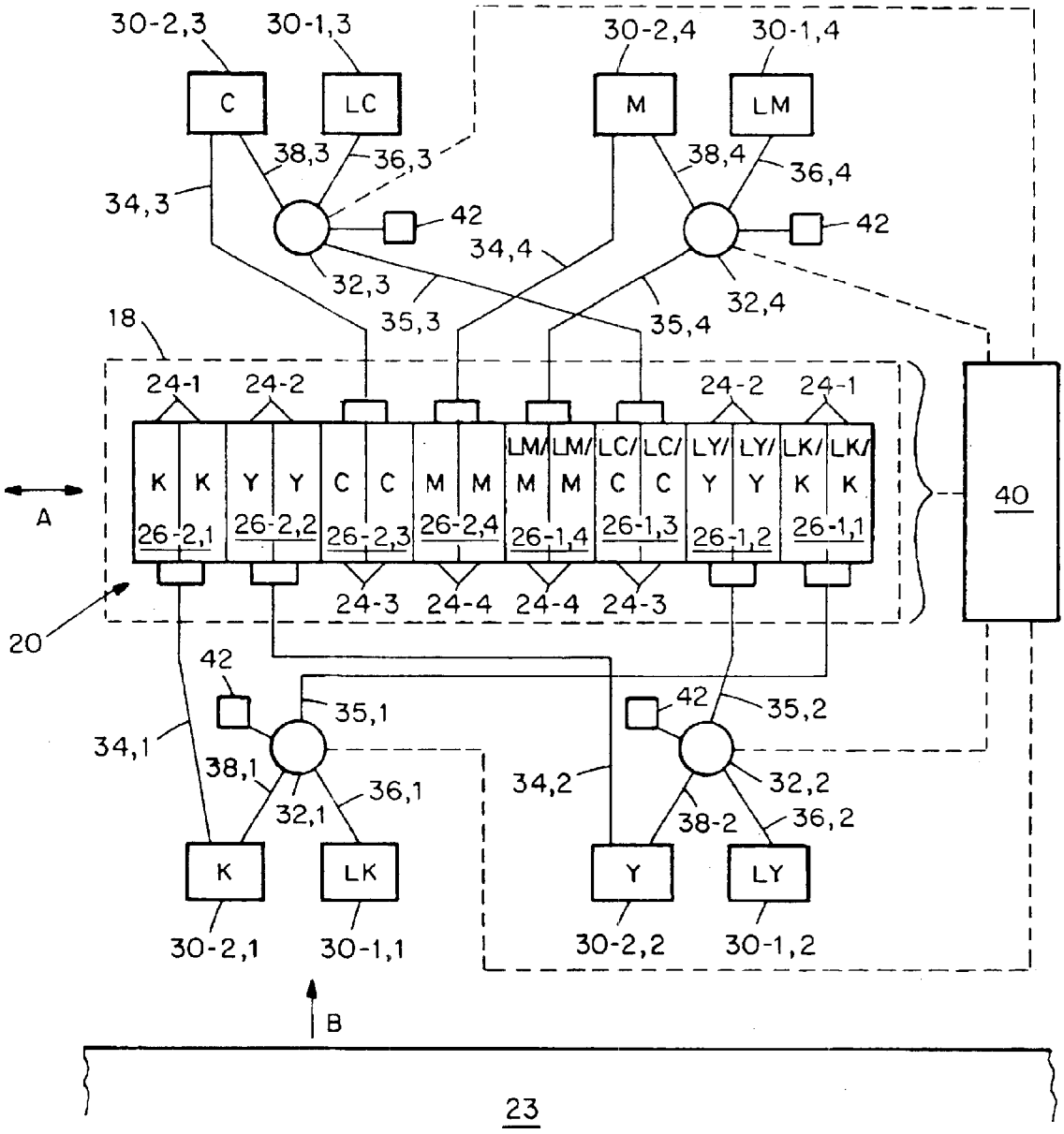
FIG. 2 is a block diagram view of a carriage of the printing system of FIG. 1 holding a set of print heads connected to respective ink reservoirs in accordance with the invention.

There is illustrated in FIG. 2 the physical arrangement of the series of print heads 20 as they are mounted in the carriage 18. However, the present invention is not limited to the number of print heads nor to the horizontal physical layout of the print heads shown in FIG. 2. For example, there may be a greater or fewer number of print heads, and the print heads may be arranged vertically, that is, arranged along an axis which extends in the direction of movement of the substrate (arrow B). Furthermore, the invention is not limited for use in the printing system shown in FIG. 1. That is, embodiments of the invention can be used in any suitable printing system. The inks used in the printing system can be solvent-based inks or water-based inks.

The series of print heads 20 includes a first, second, third, and fourth set of print heads, 24-1, 24-2, 24-3, and 24-4, respectively. And each set includes a first pair of print heads 26-1,*i* and a second pair of print heads 26-2,*i*, where j refers to the identifying number of the particular set of heads, -1, -2, -3, or -4. Thus each set of print heads includes four print heads.

In the illustrated embodiment shown in FIG. 2, the first pair of the first set of print heads 26-1,1 deposit either dark black (K) ink or light black (LK) ink, and the second pair of print heads 26-2,1 deposit dark black (K) ink; the first pair of the second set 26-1,2 deposits either dark yellow (Y) or light yellow (LY) ink, and the second pair 26-2,2 of the same set deposits dark yellow (Y) ink; the first pair of the third set 26-1,3 deposits either light cyan (LC) or dark cyan (C) ink, and the second pair 26-2,3 deposits dark cyan (C) ink; and the first pair of the fourth set 26-1,4 deposits light magenta (LM) or dark magenta (M) ink, and the second pair 26-2,4 of that set deposits dark magenta (M) ink.

Associated with each set of print heads is a pair of reservoirs 30 and a selector valve 32,j, where again j refers to the identifying number of the particular set of heads. Each pair of reservoirs includes a first reservoir 30-1,j and a second reservoir 302,j. The second pair of each set of print heads 26-2,j is connected directly to a respective second reservoir 30-2,*i* with a transmission line 34,j through which ink is transported from the second reservoir 30-2,j to the second pair of print heads 26-2,j. The first pair of print heads of each set 26-1,*i* is connected to a respective selector valve 32,*i* with a transmission line 35,j, and each selector valve 32,j in turn is connected to both the first reservoir 30-1,j and the second reservoir 30-2,j with a transmission line 36,j and a transmission line 38,j, respectively. The transmission lines 35,j, 36,j and 38,j facilitate the transmission of ink from either the first reservoir 30-1,j or the second reservoir 30-2, j to the first pair of print heads 26-1,*i*.

Each selector valve 32,j has two states, corresponding to the two modes of operation of the printing system 10, the selection of which is controlled by a controller 40, such as a central processing unit of a computer, or a stand alone microprocessor. The controller 40 can be the CPU which operates the entire printing system, or, alternatively, a user manually operates the controller 40 to choose the specific state of the selector valves 32,j. When the controller 40 instructs the selector valves 32,j to switch to state one, the first pair of each set of print heads 26-1,j receives ink from the corresponding first reservoirs 30-1,j, which holds, for example, a light colored ink. And when the controller 40 instructs the selector valves 32,j to switch to the second state, ink is transmitted from the second reservoirs 30-2,j to the first pair of print heads 26-1,j. Thus in state one, the printing system 10 generates images with the eight colors: K, LK, Y, LY, C, LC, M, and LM, while in state two, images are created with the four base colors: K, Y, C, and M.

When the printing system 10 is in operation, and switched between state one and state two, a flushing system 42 is employed to cleanse the transmission lines 35,j, the first pair of print heads 26-1,j, and the selector valves 32,j. The flushing system 42 may be four individual systems as shown, or it may be one central system. In any case, the flushing system is typically controlled by the controller 40, although it can be controlled manually.

During the printing operation, the movement of the carriage 18 across the substrate 23 is under the direction of the controller 40 as well. The controller 40 also instructs which particular print heads in the series of print heads 20 to dispense ink onto the substrate 23 as it moves intermittently underneath the print heads.

Figure 3:
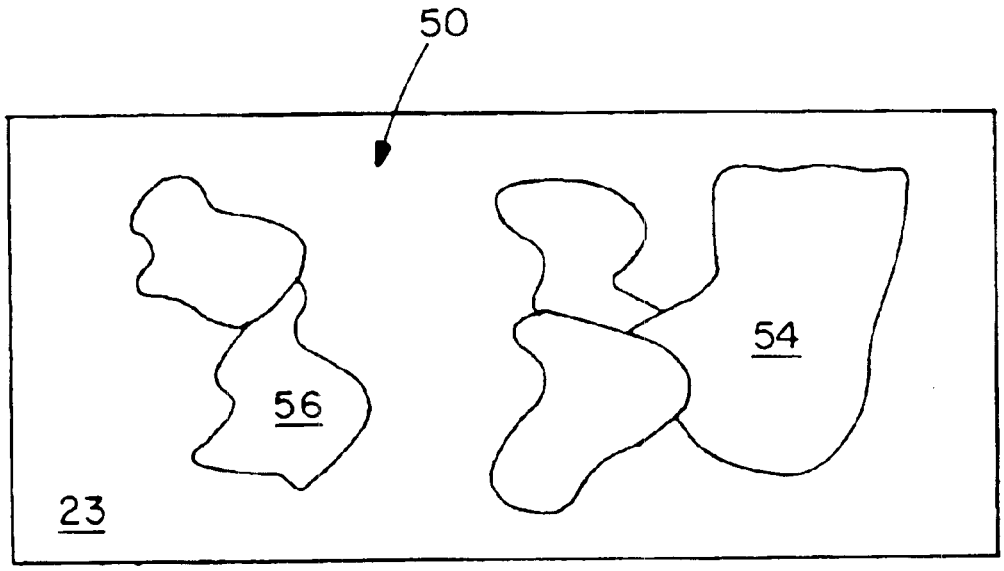
FIG. 3 is a schematic of an image printed by the printing system of FIG. 1.

Depending on which state the printing system 10 is set at, four (K,Y,C,M) or eight (K,Y,C,M,LM,LC,LY,LK) colors are used alone or in combination to create a desired image 50 on the substrate 23, as shown in FIG. 3. Thus, the image 50 is made of colored regions having one to four (state two), or one to eight (state one), layers of ink. For example, when the system is set in state two, a green region 54 of the image 50 is produced by depositing two layers of ink, namely, yellow and cyan. And an intense black region 56 of the image 50 results from dispensing the four colors, cyan, magenta, yellow, and black, such that this intense black region is made of four layers of ink.

Figure 4A:
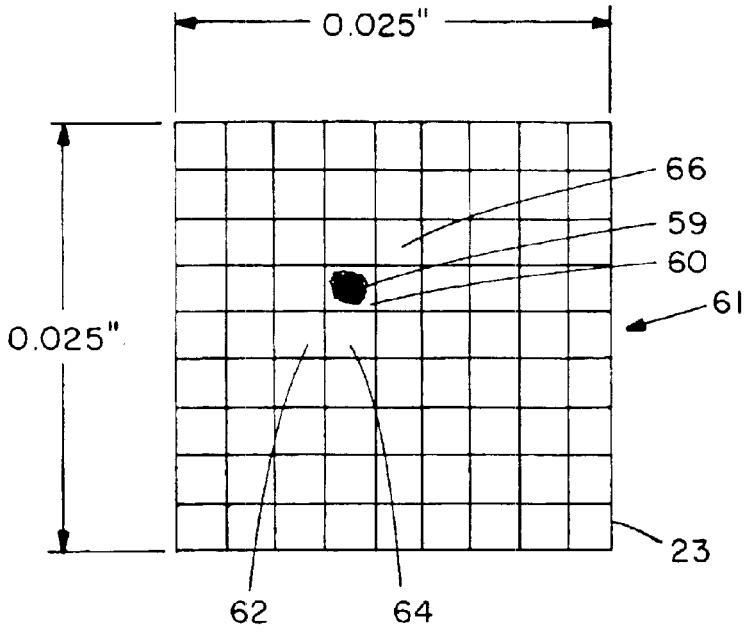
FIG. 4A illustrates the resolution of an image generated by the print heads of FIG. 2A when the print heads are set for high-speed mode.
Figure 4B:
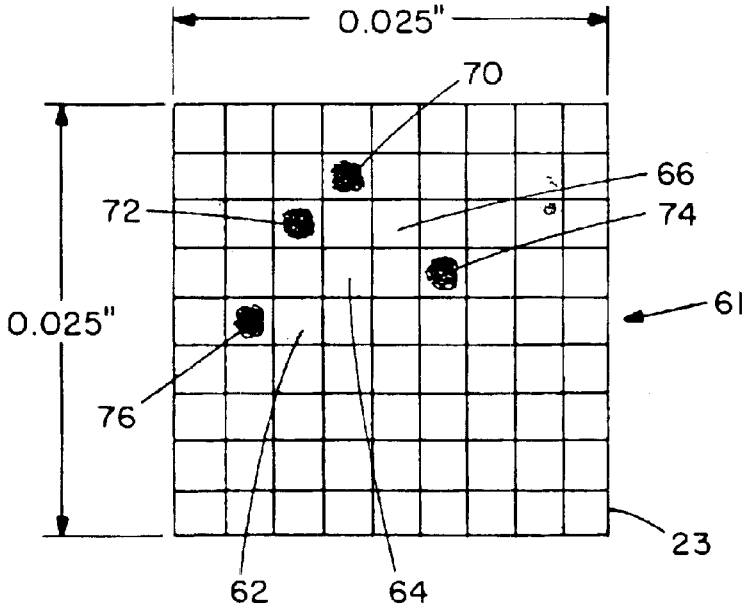
FIG. 4B illustrates the resolution of the same image of that of FIG. 3A generated by the print heads of FIG. 2 when the print heads are set for high-quality mode.

It is of particular interest that the visual intensity of a particular color can be altered by varying the amount of "white space" that surrounds the ink deposited on the substrate, as illustrated in FIGS. 4A and 4B.

Shown in FIG. 4A is a single drop of yellow ink 59 deposited, for example, on a 0.025 inch by 0.025 inch subregion 60 of the region 61. Thus the yellow ink droplet 59 is about 1/360 inch in diameter, which is the typical size of the dispensed droplets generated by a printing system capable of creating images with a resolution of 360 dpi (drops per inch). If additional yellow droplets are deposited, for example, in subregions 62, 64, and 66, an observer viewing the image would perceive the yellow to be more intense than if only a single yellow droplet 59 is deposited on the subregion 60 Thus the intensity of the color can be controlled by varying the amount of "white space," that is, regions which are absent of ink, surrounding the deposited ink.

Alternatively, the printing system 10 is capable of using four additional colors to generate the images. As mentioned above, the system uses light colored inks (LK,LY,LC,LM) in addition to the four dark colored inks when the system operates in state one. By using these light colored inks, the printing system creates images having the same visual intensity as that created with the four colored inks. With these additional colors, the images will appear less "grainy." For instance, as shown in FIG. 4B, four light yellow droplets, 70, 72, 76, 78 in the region 61 is seen by a viewer to be less grainy than a single dark yellow droplet 59 (FIG. 4A) in the same region. However, the four light yellow droplets in FIG. 4B provide the same optical density as the single dark yellow 60 of FIG. 4A when either is seen by an observer.

Note, that a single subregion may be occupied by more than one colored ink. Thus, in state one the printing system is able to deposit one to eight colored inks in a single 1/360 inch by 1/360 subregion of the substrate 23 by using the arrangement of the series of print heads 20 now shown in greater detail in FIG. 5.

Figure 5:
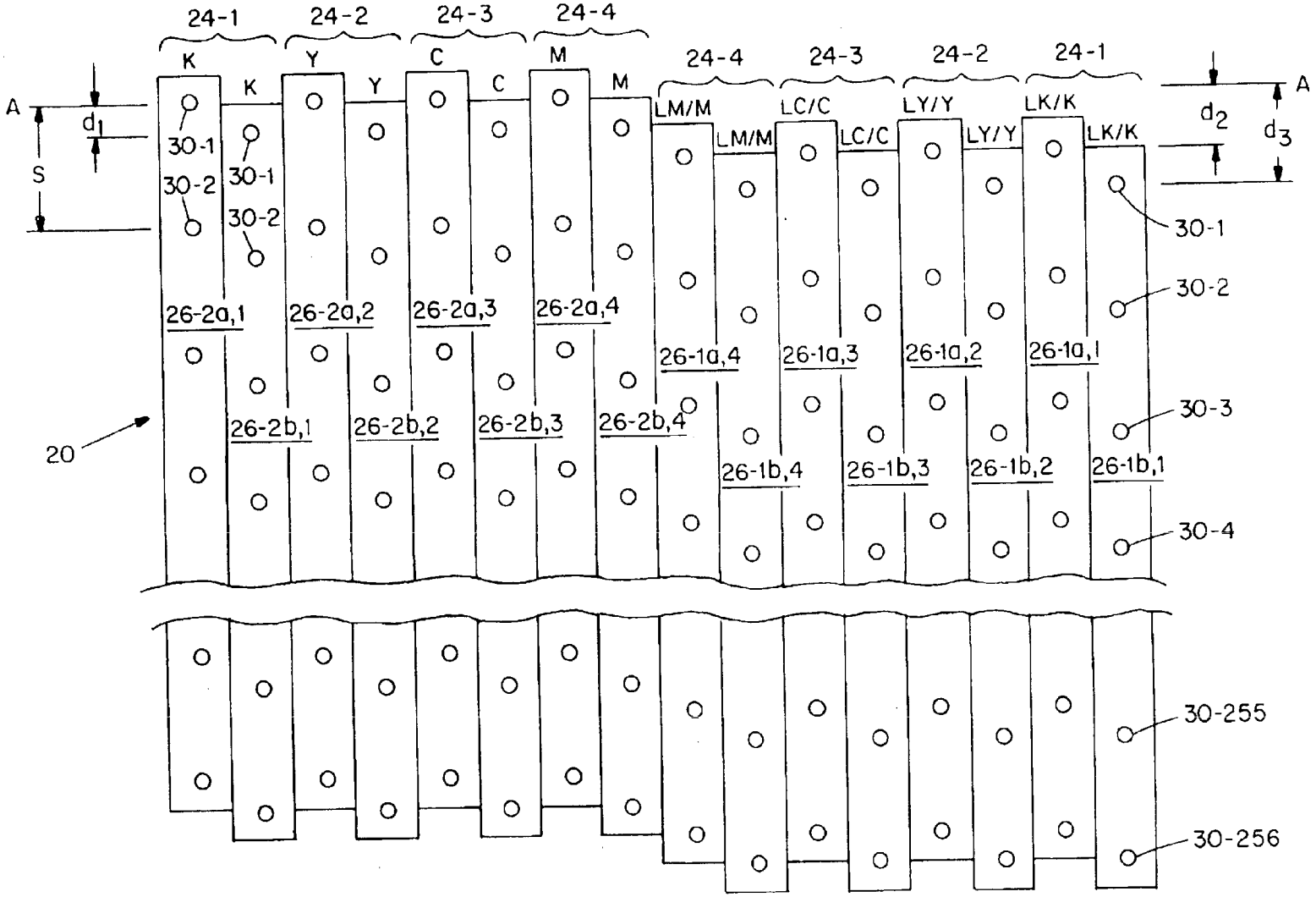
FIG. 5 is a detailed view of the print heads of FIG. 2.

As illustrated in FIG. 5, each set of print heads 24-j includes four individual print heads. The print heads for the first pair and the second pair of each set are identified as 26-1*i*,j, and 26-2*i*,j, respectively, where i=a or b indicates the individual print head. Each individual print head is provided with a multiplicity of nozzles 30. In the illustrated embodiment shown, each print head 26-1*i*,j or 26-2*i*,j has 256 nozzles labeled 30-1 through 30-256. Thus when the printing system operates in a state one condition, 512 nozzles are used to dispense each of the colored inks K, LK, Y, LY, C, LC, M, and LM. And when the system is set for state two, 1024 nozzles are employed to deposit each of colored inks K, Y, C, and M.

For each print head 26-1*i*,j or 26-2*i*,j, the spacing, "s," between the nozzles 30 is about 4/360 inch. Thus, for a 360 dpi system, the nozzles for each print head of each set (of four print heads) are offset from each other by a distance of 1/360 inch. For example, if the reference line A—A identifies the position of the nozzle 30-1 of the print head 26-2*a*,1 of the first set of print heads, then the nozzles 30-1 of the print heads 26-2*b*,1, 26-1*a*,1, and 26-1*b*,1 are offset by the distances "d1," of 1/360 inch, "d2," of 2/360 inch, and "d3," of 3/360 inch, respectively, from the reference line A—A. The print heads of the other three sets are arranged so that the nozzles 30 of these print heads are similarly offset.

While this invention has been particularly shown and described with references to preferred embodiments thereof, it will be understood by those skilled in the art that various changes in form and details may be made therein without departing from the scope of the invention encompassed by the appended claims. For example, the system is able to switch from a fast drying ink to a slow drying ink without removing the print heads or transmission lines.

What is claimed is:

1. A printing apparatus for printing images on a substrate, comprising:

a first print head which deposits first or second ink onto the substrate;

a selector valve in fluid communication with the first print head, the selector valve having a first state and a second state;

a first reservoir containing the first ink and selectively in fluid communication with the selector valve;

a second reservoir containing the second ink and selectively in fluid communication with the selector valve, and a second print head in fluid communication with the second reservoir;

whereby when the selector valve is switched to the first state the first reservoir is in fluid communication with the first print head, and when switched to the second state the second reservoir is in fluid communication with the first print head.

2. The printing apparatus of claim 1, further comprising a controller coupled to the selector valve, the controller transmitting signals to the selector valve to switch the selector valve between the first state and the second state.

3. The printing apparatus of claim 2, wherein the controller is computer operated.

4. The printing apparatus of claim 2, wherein the controller is manually operated.

5. The printing apparatus of claim 1, wherein the second print head is in fluid communication with the selector valve, wherein the first print head and the second print head are a first pair of print heads, whereby when the selector valve is switched to the first state the first reservoir is in fluid communication with the first pair of print heads, and when switched to the second state the second reservoir is in fluid communication with the first pair of print heads.

6. The printing apparatus of claim 5, further comprising a second pair of print heads that includes a third print head and a fourth print head, the second pair of print heads being in fluid communication with the second reservoir, wherein the first pair of print heads and the second pair of print heads is a first set of print heads.

7. The printing apparatus of claim 6, further comprising one or more additional sets of print heads, one or more pairs of first and second reservoirs, and one or more selector valves, wherein a second pair of each set of print heads is in fluid communication with the second reservoir of a respective pair of reservoirs, and a corresponding first pair of print heads is in fluid communication with a respective selector valve so that when the respective selector valve is switched to the first state the first reservoir of the corresponding pair of reservoirs is in fluid communication with the corresponding first pair of print heads, and when switched to the second state the second reservoir of the corresponding pair of reservoirs is in fluid communication with the first pair of print heads.

8. The printing apparatus of claim 7, wherein the number of additional first pair of print heads is equal in number to the number of additional second pair of print heads, is equal in number to the additional pairs of ink reservoirs, and is equal in number to the additional selector valves.

9. The printing apparatus of claim 8, wherein the number of additional first pair of print heads, additional second pair of print heads, additional pairs of reservoirs, and additional selector valves is three.

10. The printing apparatus of claim 9, wherein the first reservoir and the second reservoir of the first pair of reservoirs hold light black ink, and dark black ink, respectively, the first reservoir and the second reservoir of the second pair of reservoirs hold light yellow ink, and dark yellow ink, respectively, the first reservoir and the second reservoir of the third pair of reservoirs hold light cyan ink, and dark cyan ink, respectively, and the first reservoir and the second reservoir of the fourth pair of reservoirs hold light magenta ink, and dark magenta ink, respectively.

11. The printing apparatus of claim 9, wherein the second set of print heads is positioned between the first pair and the second pair of the first set of print heads, the third set of print heads is positioned between the first pair and the second pair of the second set of print heads, and the fourth set of print heads is positioned between the first pair and the second pair of the third set of print heads.

12. The printing apparatus of claim 11, wherein the first pair and the second pair of the second set are positioned adjacent to the first pair and the second pair of the first set, respectively, the first pair and the second pair of the third set are positioned adjacent the first pair and the second pair of the second set, respectively, and the first pair and the second pair of the fourth set are positioned adjacent to the first pair and the second pair of the third set, respectively, so that the first pair and the second pair of fourth set are also positioned adjacent to each other.

13. The printing apparatus of claim 12, wherein the selector valve and the print head are flushed before the selector valve is switched from one state to the other.

14. The printing apparatus of claim 12, wherein the selector valve and the print head are flushed after the selector valve is switched from one state to the other.

15. A method of printing on a substrate, comprising:

depositing a first ink or a second ink from a first print head;

selecting between a first state of operation and a second state of operation, so that when in the first state of operation a first reservoir holding the first ink is in fluid communication with the first print head, and when in the second state of operation a second reservoir holding the second ink is in fluid communication with the first print head; and depositing the first ink or the second ink from a second print head, wherein the first print head and the second print head are a first pair of print heads, and when in the first state the first reservoir is in fluid communication with the first pair of print heads, and when in the second state the second reservoir is in fluid communication with the first pair of print heads.

16. The method of claim 15, further comprising depositing the second ink from a second pair of print heads that includes a third print head and a fourth print head, wherein the first pair of print heads and the second pair of print heads is a first set of print heads.

17. A method of printing images on a substrate, comprising:

depositing a first ink or a second ink from a first print head;

selecting between a first state of operation and a second state of operation, so that when in the first state of operation a first reservoir holding the first ink is in fluid communication with the first print head, and when in the second state of operation a second reservoir holding the second ink is in fluid communication with the first print head; and depositing the second ink from a second print head in fluid communication with the second reservoir.

18. The method of claim 17, wherein the selecting between the first and second state is under the direction of a controller.

19. The method of claim 18, wherein the controller is computer operated.

20. The method of claim 18, wherein the controller is manually operated.

21. A printing apparatus for printing images on a substrate, comprising:

a first print head which deposits first or second ink onto the substrate;

a selector valve in fluid communication with the first print head, the selector valve having a first state and a second state;

a first reservoir containing the first ink and selectively in fluid communication with the selector valve;

a second reservoir containing the second ink and selectively in fluid communication with the selector valve, and a flushing mechanism for flushing ink from the selector valve and the first print head when the selector valve is switched between the first state and the second state;

whereby when the selector valve is switched to the first state the first reservoir is in fluid communication with the first print head, and when switched to the second state the second reservoir is in fluid communication with the first print head.

22. A method of printing on a substrate, comprising:

depositing a first ink or a second ink from a first print head;

selecting between a first state of operation and a second state of operation, so that when in the first state of operation a first reservoir holding the first ink is in fluid communication with the first print head, and when in the second state of operation a second reservoir holding the second ink is in fluid communication with the first print head; and flushing ink from the first print head when switching between the first state and the second state.

23. The method of claim 22, wherein the flushing occurs before switching between the first and second states.

24. The method of claim 22, wherein the flushing occurs after switching between the first and second states.

* * * * *